US007490597B2

(12) United States Patent
Hatcher

(10) Patent No.: US 7,490,597 B2
(45) Date of Patent: Feb. 17, 2009

(54) POSITIVE FIT FEED ADAPTER FOR PAINTBALL GUN

(76) Inventor: Forest A. Hatcher, 920 Lambert Ave., Flagler Beach, FL (US) 32136

( * ) Notice: Subject to any disclaimer, the term of this patent is extended or adjusted under 35 U.S.C. 154(b) by 704 days.

(21) Appl. No.: 10/617,913

(22) Filed: Jul. 11, 2003

(65) Prior Publication Data

US 2004/0112356 A1 Jun. 17, 2004

Related U.S. Application Data

(62) Division of application No. 09/842,351, filed on Apr. 25, 2001, now Pat. No. 6,591,824.

(60) Provisional application No. 60/200,143, filed on Apr. 27, 2000.

(51) Int. Cl.
*F41B 11/02* (2006.01)

(52) U.S. Cl. ..... 124/49; 124/74

(58) Field of Classification Search ..... 124/45, 124/49, 51.1, 73, 74; 285/351, 353, 354
See application file for complete search history.

(56) References Cited

U.S. PATENT DOCUMENTS

| | | | | |
|---|---|---|---|---|
| 661,352 | A * | 11/1900 | Moody | 285/347 |
| 770,525 | A * | 9/1904 | Hussey | 277/607 |
| 2,438,529 | A * | 3/1948 | Woodling | 285/281 |
| 2,829,909 | A * | 4/1958 | Magnani | 285/345 |
| 5,282,454 | A * | 2/1994 | Bell et al. | 124/49 |
| 6,588,412 | B2 * | 7/2003 | Ferrara et al. | 124/49 |
| 2002/0129804 | A1 * | 9/2002 | Sullivan et al. | 124/49 |
| 2002/0129805 | A1 * | 9/2002 | Sullivan, Jr. | 124/49 |

* cited by examiner

*Primary Examiner*—John Ricci
(74) *Attorney, Agent, or Firm*—Ryan Kromholz & Manion S.C.

(57) ABSTRACT

A positive fit feed adapter for use between a paintball loader and a paintball gun. The feed adapter includes a threaded connector formed on either the paintball gun or the paintball loader. The threaded connector includes a plurality of expansion slots that allow the outer diameter of the connector to expand or compress. The feed adapter further includes a collet having an internally threaded surface that is tapered from a first end to a second end. When the feed tube from the other of the paintball gun and the paintball loader is inserted into the threaded connector, the collet is tightened along the external threads to reduce the diameter of the connector to provide a positive fit between the paintball gun and the paintball loader.

3 Claims, 9 Drawing Sheets

FIG. 6
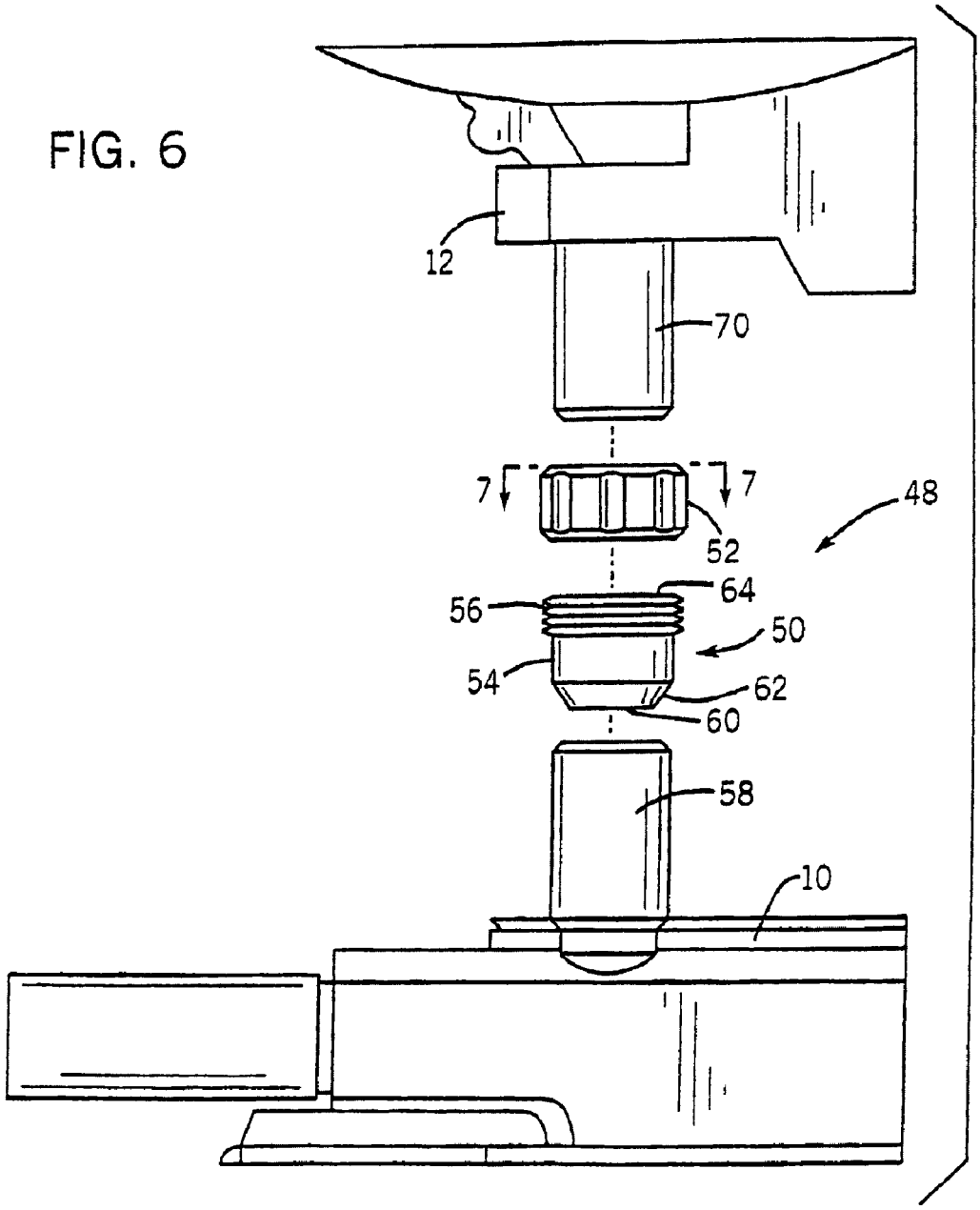
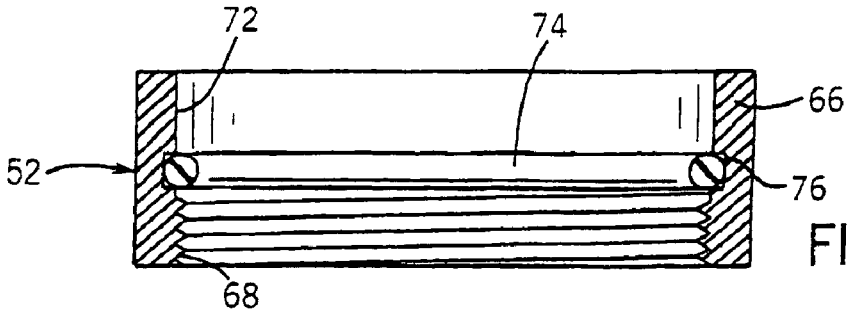
FIG. 7

FIG. 8
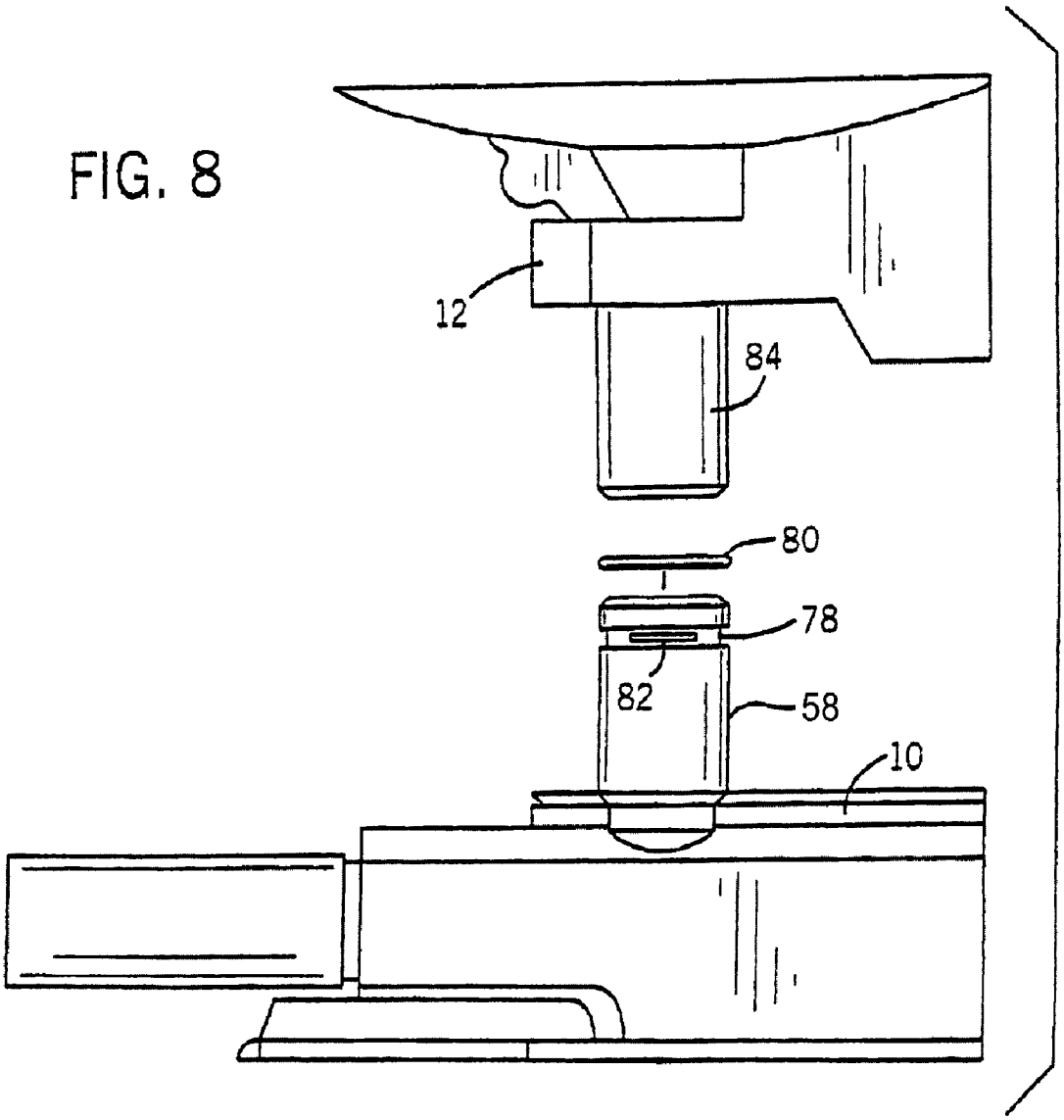
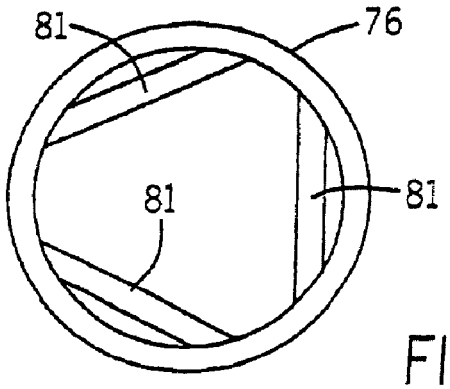
FIG. 9

POSITIVE FIT FEED ADAPTER FOR PAINTBALL GUN

CROSS-REFERENCE TO RELATED APPLICATIONS

This application is a divisional of application of U.S. Ser. No. 09/842,351, filed Apr. 25, 2001, now U.S. Pat. No. 6,591,824, which claims priority to provisional application No. 60/200,143, filed on Apr. 27, 2000.

BACKGROUND OF THE INVENTION

The present invention relates to an adapter for use in holding two separate devices in a manner such that they will not become separated. More specifically, the present application is directed to a positive fit feed adapter for use in attaching a paintball gun and paintball loader such that the two devices will not separate when subjected to normal stresses yet can be separated by the user on demand in a simple manner.

Currently, several different types of methods and devices are used to attach a paintball loader to a paintball gun. Paintball guns are typically provided with a feed port, which is an opening into the breach of the gun that allows paintballs to feed from the loader into the breach. In most cases, a tubular element, referred to as a feed tube, is used in combination with the feed port to allow the supply of paintballs to enter into the paintball gun. The feed tube can be formed contiguous with the feed port or can be manufactured as a separate element and attached to the feed port in one of several different manners.

Paintball loaders are typically provided as a separate unit from the paintball gun and include a loader neck. The loader neck of the paintball loader typically requires an additional element to be attached to either the feed port of the paintball gun or the feed tube positioned within the feed port of the gun. These additional elements, commonly referred to as "elbows", utilize pressure fit or clamping means to retain the paintball loader in place.

Currently, loaders are provided by various different manufacturers and in various different models and sizes, as are the elbows used to couple the loader to the feed tube of the paintball gun. Typically, the fit between the paintball loader and the elbow is rarely sufficient to retain the loader in place when the loader is subjected to the stresses of normal use during a paintball game. Further, the fit between the two devices varies depending on the manufacturing tolerances of the devices and the normal wear that occurs during the life of the products.

It is currently anticipated that new paintball loaders and feed devices will not be passive in operation (using gravity, for example), but will use mechanical, pneumatic, electronic or combinations of these means to move the paintballs between the loader and the breach of the gun. These types of active feed systems increase the weight and size of the loader, which creates even greater stress on the junction between the loader and the feed port, thereby requiring an even firmer fit and attachment between the paintball loader and the feed port of the paintball gun.

SUMMARY OF THE INVENTION

The present invention is a positive fit feed adapter used to connect a paintball loader to a paintball gun. The positive fit feed adapter of the present invention uses a resilient or collapsible member to create a positive fit between the paintball loader and the paintball gun. The feed adapter of the present invention can be formed as an integrated part of a feed elbow, an integrated part of a paintball loader, or as an integrated part of the feed port of the paintball gun.

The present invention relates to a feed adapter used in providing a positive fit between a paintball loader and a paintball gun. The positive fit feed adapter allows the paintball gun and the paintball loader to be securely connected and prevents separation during normal usage.

In the first embodiment of the invention, the feed tube of the paintball gun includes a connector portion having external threads and a plurality of expansion slots extending from the outer end of the feed tube. The external threads formed on the connector portion of the feed tube of the paintball gun are received by a corresponding set of internal threads formed on a collet. The internal diameter of the collet is tapered from a first end to a second end such that as the collet is tightened along the connector portion of the feed tube, the diameter of the feed tube is constricted. The constriction of the externally threaded feed tube is facilitated by the expansion slots formed therein.

In a second embodiment of the invention, a connector portion having external threads is formed on the loader neck of the paintball loader. Like the first embodiment, a collet having internal threads and an internally tapered surface decreasing in diameter from a first end to a second end is provided. During use, the smooth feed tube from the paintball gun is inserted into the threaded loader neck of the paintball loader and the collet is tightened along the external threads of the connector portion. The expansion slots formed on the threaded loader neck allow the loader neck to contract to provide a positive fit between the paintball gun and the paintball loader.

In a third embodiment of the invention, an elbow adapter is provided having a threaded connector formed on each of its ends. Each threaded connector includes a series of expansion slots. Each end of the elbow adapter receives either the loader neck of the paintball loader or the feed tube of the paintball gun. A pair of threaded collets, each of which have an internally tapered surface, can be tightened along the threaded connectors to provide a positive fit between the elbow adapter and the respective device.

In a fourth embodiment of the invention, the feed adapter includes an adapter cylinder sized to be received within the feed tube of the paintball gun. The adapter cylinder includes an externally threaded top portion that is received by a corresponding threaded portion of a collet. The collet further includes at least one elastic O-ring positioned along its internal surface. As the collet is tightened along the threaded portion of the adapter cylinder, the internally positioned O-ring tightens around the feed tube of the paintball loader to provide a positive fit between the paintball loader and the paintball gun.

In a fifth embodiment of the invention, the feed tube of the paintball gun includes an external notch that receives an O-ring. The feed tube of the paintball gun preferably includes a series of slots that allow the O-ring to extend into the interior of the feed tube. When the loader neck of the paintball loader is inserted into the paintball gun, the extending portions of the O-ring allow the O-ring to provide a positive fit and compensate for differences in diameter between the feed tube of the paintball gun and the paintball loader.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 7 is a section view taken along line 7-7 of FIG. 6;

FIG. 8 is an exploded view illustrating the fifth embodiment of the feed adapter of the present invention; and FIG. 9 is a top view of the feed adapter illustrated in FIG. 8.

DETAILED DESCRIPTION OF THE INVENTION

Figure 1:
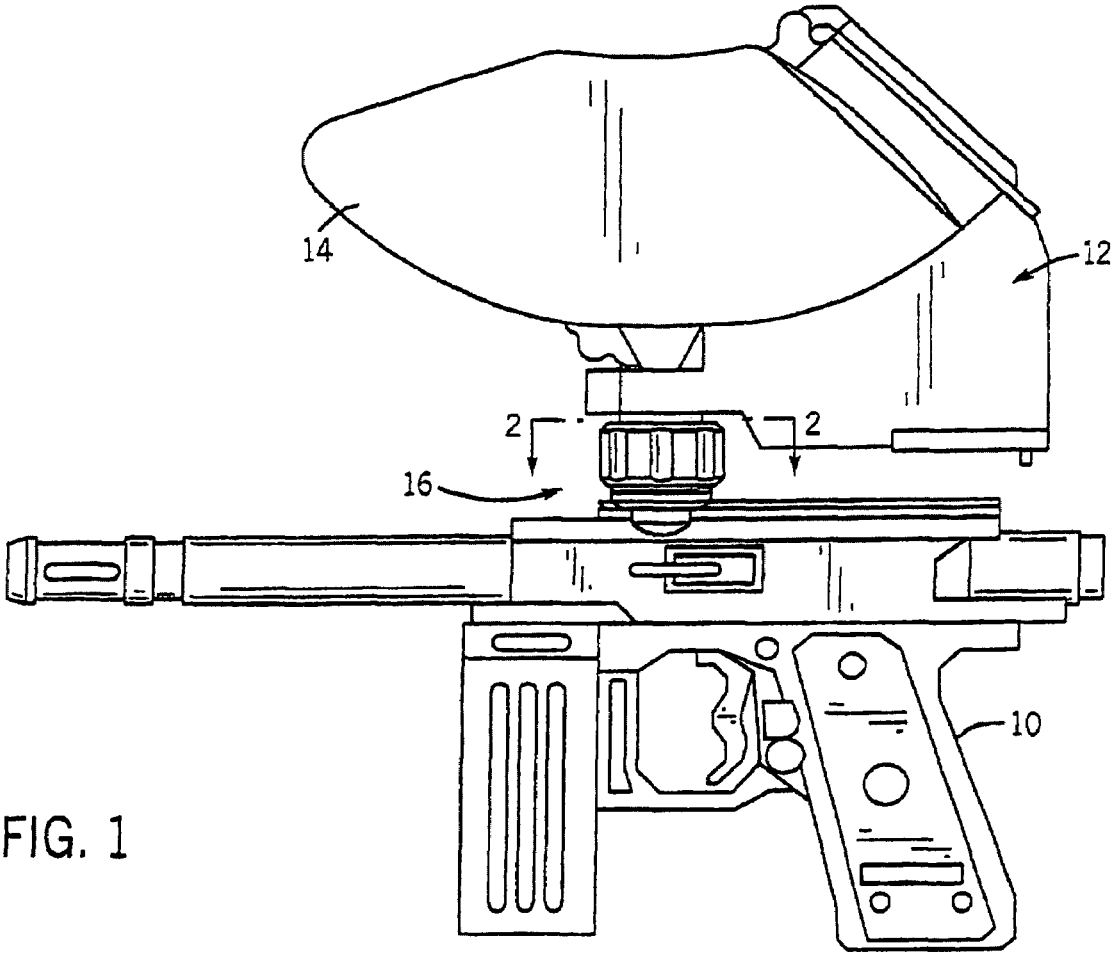
FIG. 1 illustrates a paintball loader mounted to a paintball gun by a feed adapter of the present invention.

Referring first to FIG. 1, thereshown is a paintball gun 10 onto which a paintball loader 12 is mounted. The paintball loader 12 includes a storage hopper 14 that is used to store a supply of paintballs which are fed into the paintball gun 10 for firing. As illustrated in FIG. 1, a feed adapter 16 is positioned between the paintball loader 12 and the paintball gun 10 in order to provide a positive fit between the loader 12 and the gun 10. The feed adapter 16 allows for a positive fit between the two components while allowing the user of the paintball gun 10 to easily remove the paintball loader 12 when desired.

Figure 2:
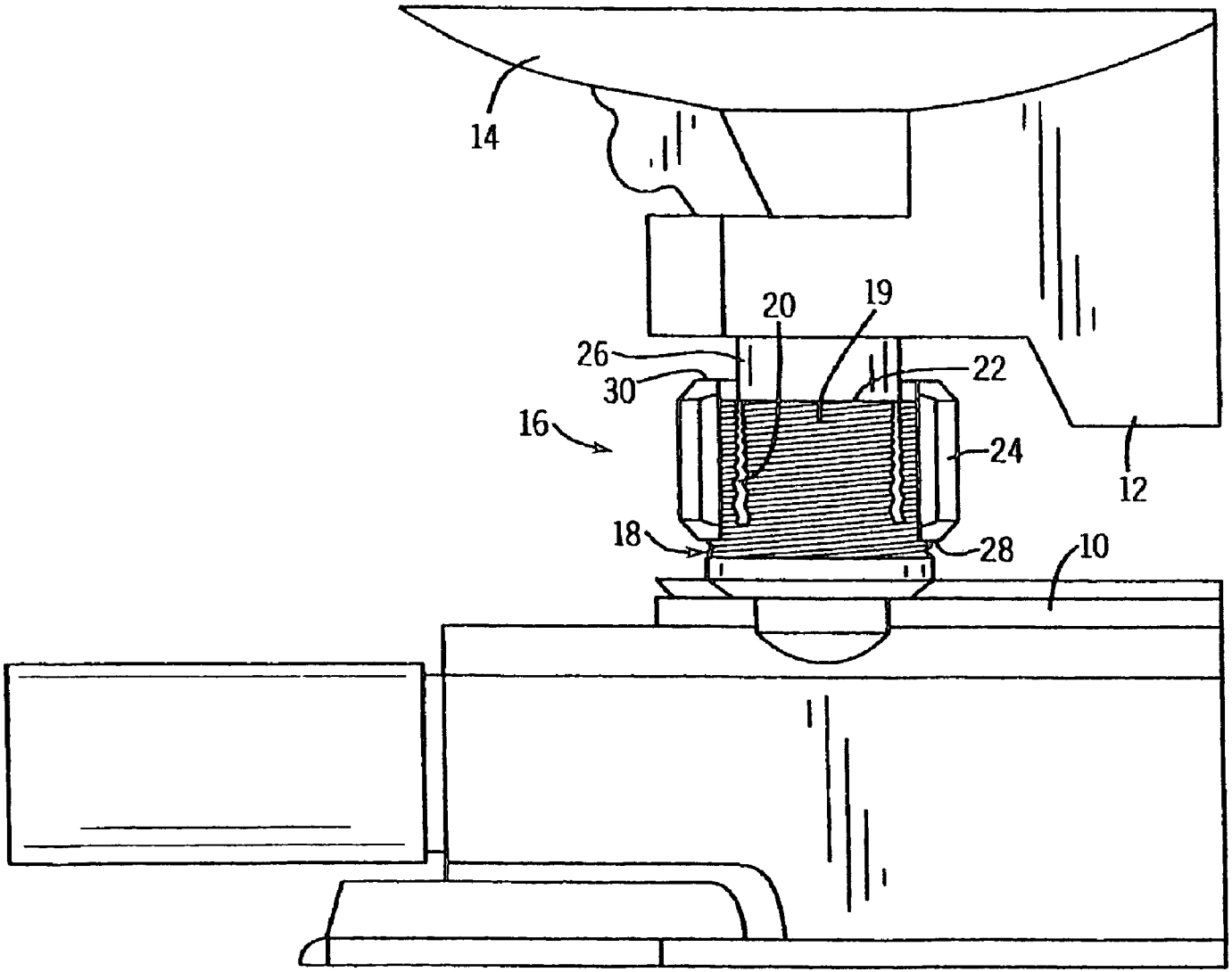
FIG. 2 is a section view taken along line 2-2 of FIG. 1.
Figure 3:
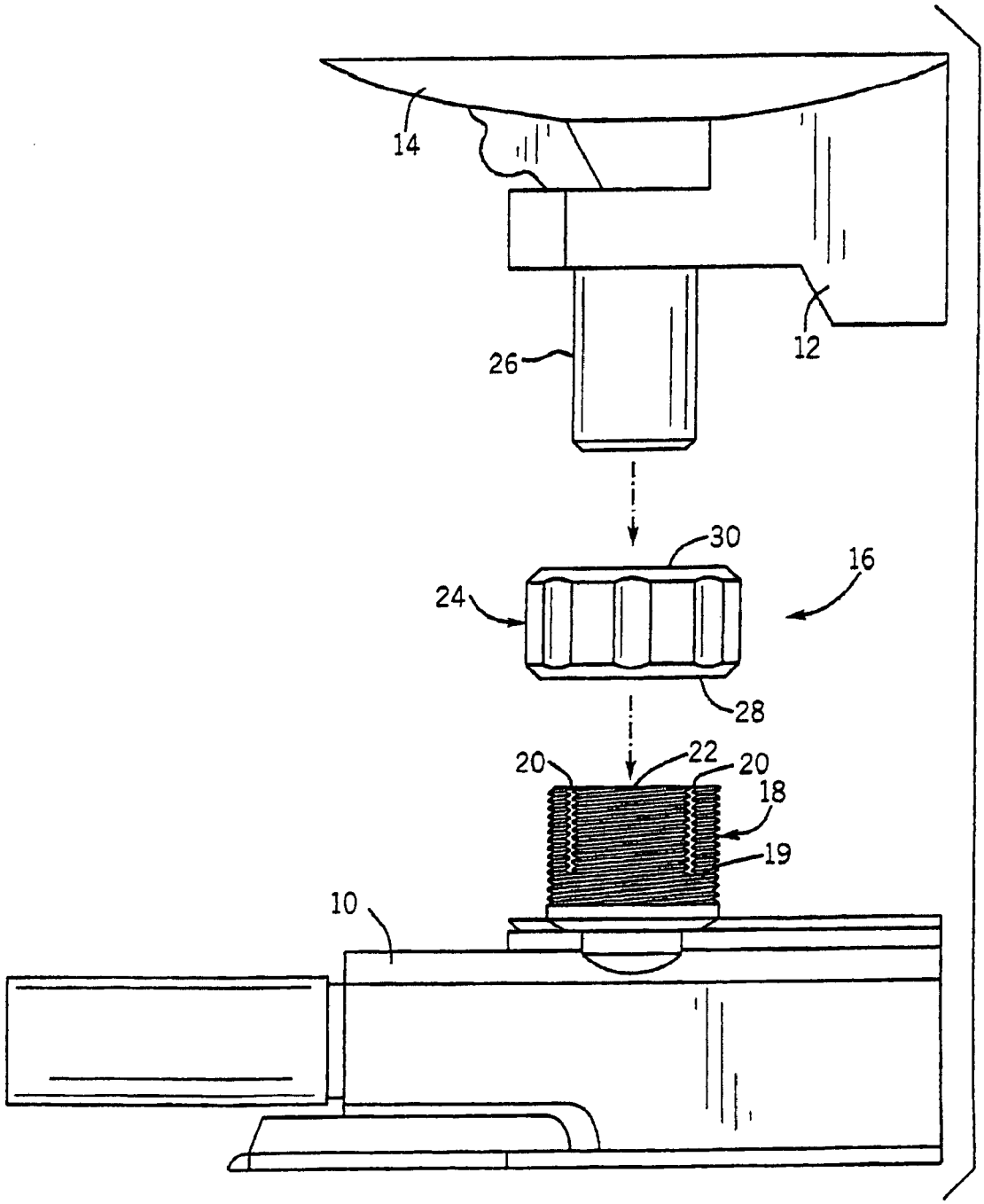
FIG. 3 is an exploded view of the first embodiment of the feed adapter of the present invention.

Referring now to FIGS. 2 and 3, thereshown is the feed adapter 16 of the first embodiment of the invention. As illustrated in FIG. 3, the paintball gun 10 includes a feed tube 18 having an externally threaded connector portion 19. The feed tube 18 and the connector 19 are integrally formed with the feed port of the paintball gun 10. The feed tube 18 provides a passageway for paintballs from the loader 14 to enter into the breach of the paintball gun 10. The connector portion 19 includes a series of compression slots 20 that extend downwardly into the feed tube 18 from the top end 22. The compression slots 20 allow the outer diameter of the feed tube 18 to compress. Preferably, the feed tube 18 is formed from a resistant, compressible material, such as plastic or metal, such that the feed tube can compress and expand, as will become evident below.

The feed adapter 16 further includes a collet 24 that can be threadedly received along the outer diameter of the connector portion 19 of the feed tube 18. The inner surface of the collet 24 includes a series of internal threads. The inner surface of the collet 24 is tapered and decreases in diameter from a first end 28 to a second end 30. The taper of the interior surface of the collet 24 functions such that as the collet 24 is tightened along the connector portion 19 of the feed tube 18, the collet 24 compresses the top end 22 of the feed tube 18.

As can be seen in FIG. 3, the loader 14 includes a loader neck 26 that extends downwardly from the storage hopper 14 to supply paintballs. As seen in FIG. 3, the loader neck 26 has a generally smooth outer circumference that is sized to be received within the threaded feed tube 18 formed on the paintball gun.

Referring now to FIG. 2, the loader neck 26 of the paintball loader 12 is positively attached to the feed tube 18 of the paintball gun 10 through the use of the collet 24 and the connector portion 19. Initially, the collet 24 is threadedly attached to only the top end of the threaded feed tube 18. The loader neck 26 of the paintball loader 12 is inserted into the feed tube 18 and the collet 24 is tightened along the connector portion 19 of the feed tube 18.

As illustrated in FIG. 2, the collet 24 is tapered from its first end 28 to the second end 30 such that as the collet 24 is tightened, the diameter of the top end 22 of the feed tube 18 compresses as a result of the compression slots 20. In this manner, the collet 24 can be used to provide a positive fit between the feed tube 18 of the paintball gun 10 and the loader neck 26 of the paintball loader 12. Thus, the user of the paintball gun 10 is able to insert the loader neck 26 of the paintball loader 12 and simply tighten the collet 24 until a positive fit is created between the two components. The positive fit between the paintball loader 12 and the paintball gun 10 allows the two components to be securely attached and prevents separation during normal use.

Although the first embodiment of the invention is shown and described in which the connector portion 19 of the feed tube 18 includes external threads and the tapered inner surface of the collet 24 includes matching threads, it is contemplated by the inventor that the threads could be removed from both the connector portion and the collet. In such an alternate embodiment, the inner surface of the collet remains tapered such that as the collet is pressed onto the feed tube, the taper of the collet compresses the connector portion. Thus, the collet still reduces the diameter of the feed tube as a result of the compression slots to provide a positive fit between the feed tube 18 of the paintball gun and the loader neck 26 of the paintball loader.

Figure 4:
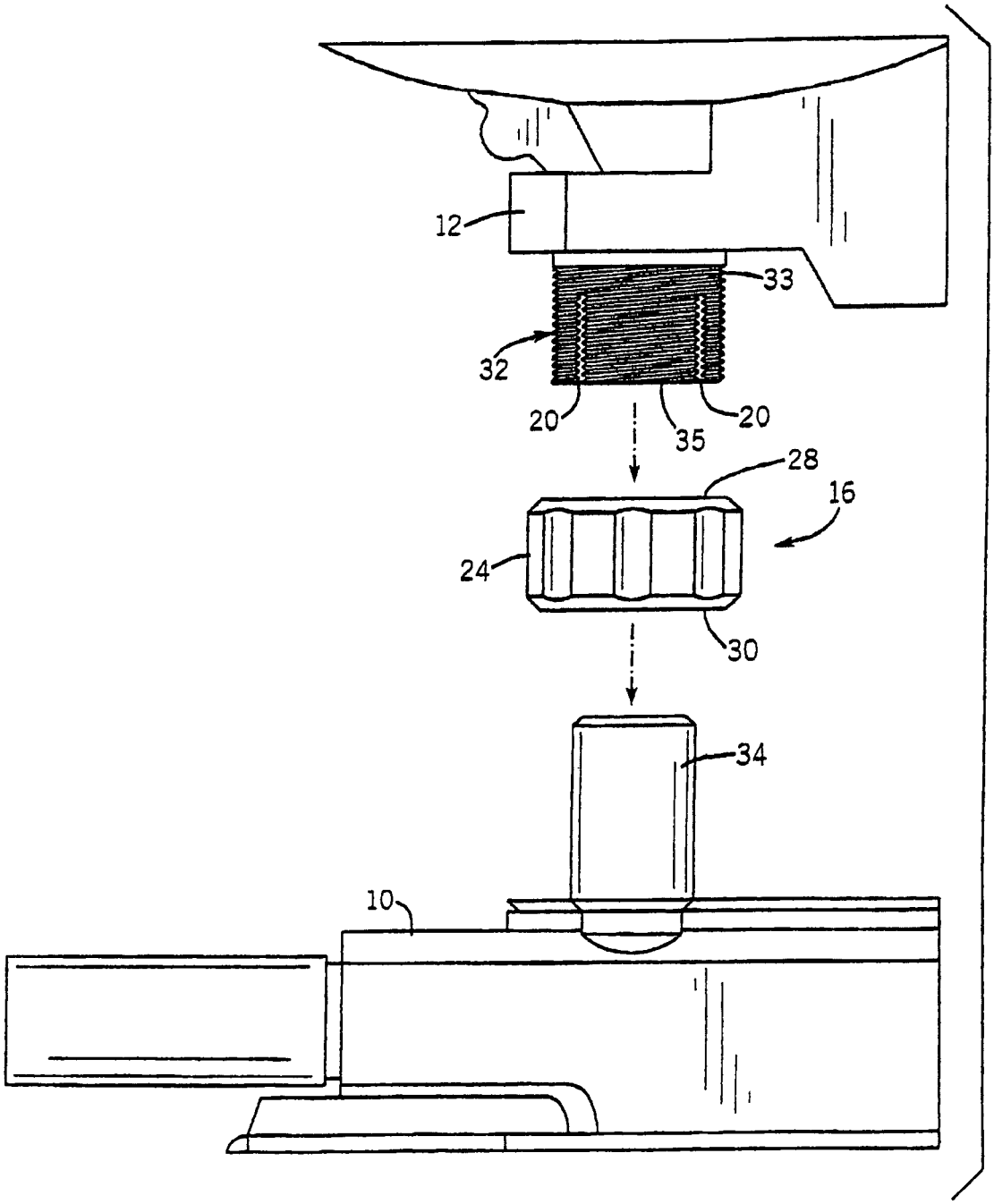
FIG. 4 is an exploded view of the second embodiment of the feed adapter of the present invention.

Referring now to FIG. 4, thereshown is a second embodiment of the feed adapter 16 of the present invention. As can be seen in FIG. 4, the paintball loader 12 includes a loader neck 32 having a connector portion 33 including exterior threads and the series of compression slots 20 extending from the outer end 36 of the loader neck 32. In the second embodiment, the paintball gun 10 includes a feed tube 34 that has a smooth outer circumference sized to be received within the threaded loader neck 32 formed on the paintball loader 12.

The collet 24 illustrated in FIG. 4 is identical to the collet of the first embodiment of FIGS. 2-3 and includes a threaded, tapered inner surface decreasing in diameter from the first end 28 to the second end 30. The positive fit connection between the paintball loader 12 and the paintball gun 10 is again carried out by tightening the collet 24 along the threaded connector portion 33 of the loader neck 32 after the feed tube 34 of the paintball gun has been placed within the loader neck tube 32. During this threaded tightening, the compression slots 20 contract to provide a positive fit between the paintball loader 12 and the paintball gun 10. Thus, as can be appreciated by comparing the embodiments of FIGS. 3 and 4, the threaded portion of the feed adapter 16 can be positioned on either the paintball gun 10 or the paintball loader 12 while operating within the scope of the present invention.

As discussed above, it is contemplated by the inventor that the tapered inner surface of the collet 24 and the outer diameter of the connector portion 33 of the loader neck 32 could be formed without any threads. In such an alternate embodiment, movement of the collet along the connector portion causes the connector portion to compress to provide a positive fit between the paintball loader 12 and the paintball gun 10.

Figure 5:
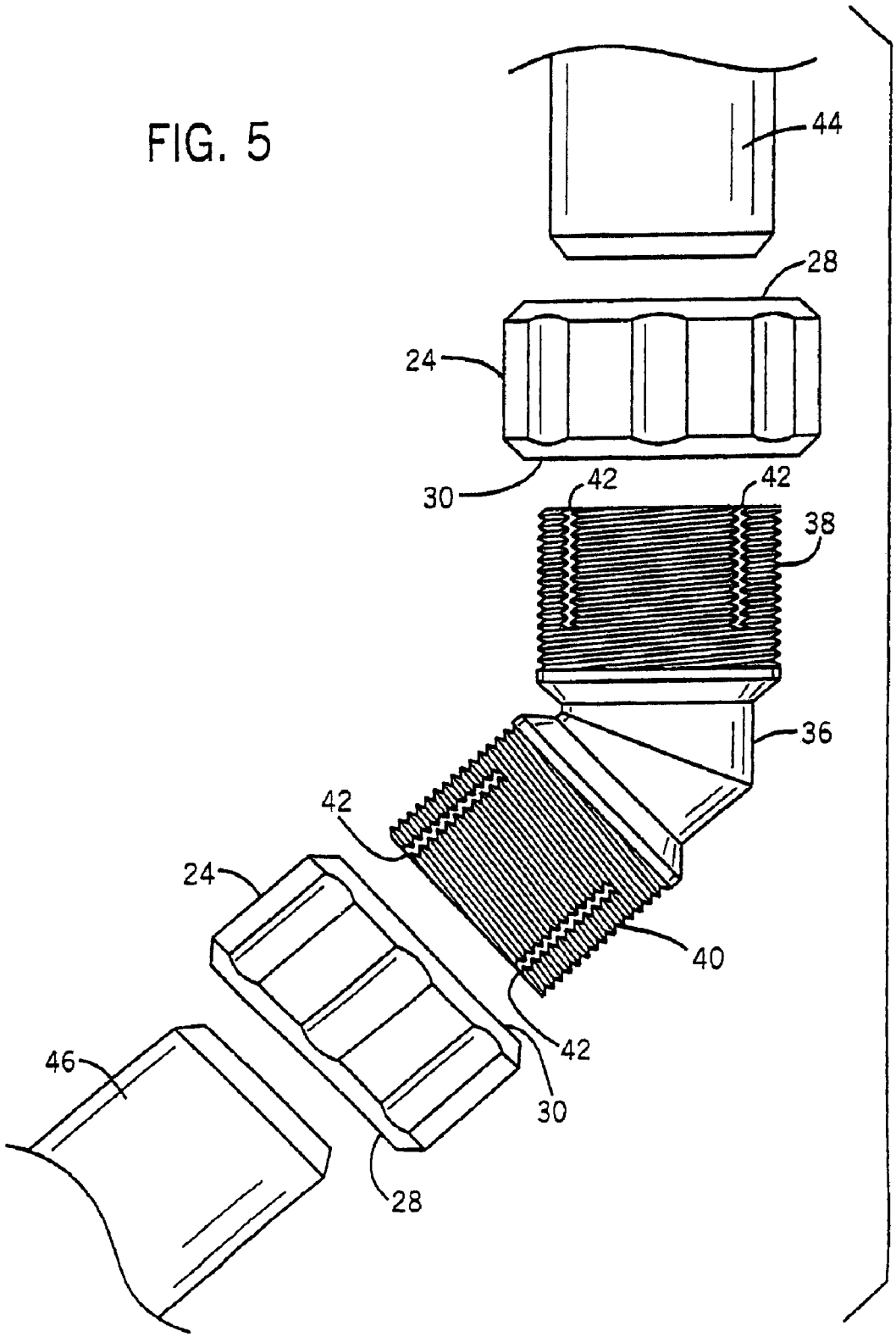
FIG. 5 is a view of a third embodiment of the feed adapter of the present invention.

Referring now to FIG. 5, thereshown is the third embodiment of the positive fit feed adapter 16 of the present invention. In the third embodiment, the feed adapter includes an elbow adapter 36 that includes a first threaded connector 38 and a second threaded connector 40. Both the first threaded connector 38 and the second threaded connector 40 include a plurality of compression slots 42 extending inwardly from the respective outer end of the threaded connector. The elbow adapter 36 is used when both the loader neck 44 of the paintball loader and the feed tube 46 of the paintball gun include a smooth outer circumference. Thus, the elbow adapter 36 is able to provide a positive fit between two standard components that have smooth feed tubes, as illustrated in FIG. 5.

As shown in FIG. 5, the elbow adapter 36 cooperates with a pair of collets 24 each of which have an internally threaded tapered surface decreasing in diameter from the first end 28 to the second end 30. Thus, as the collets 24 are tightened on the respective threaded connectors 38 and 42, the diameter of the threaded connector decreases to provide a positive fit to either the loader neck 44 or the feed tube 46. In the preferred embodiment of the invention, the elbow adapter 36 is formed from a semi-rigid material that can be compressed without breaking or shattering, such as certain types of plastic or metal. Preferably, the elbow adapter 36 is formed from a thermoplastic material that can be molded in the desired shape, as shown in FIG. 5.

Figure 6A:
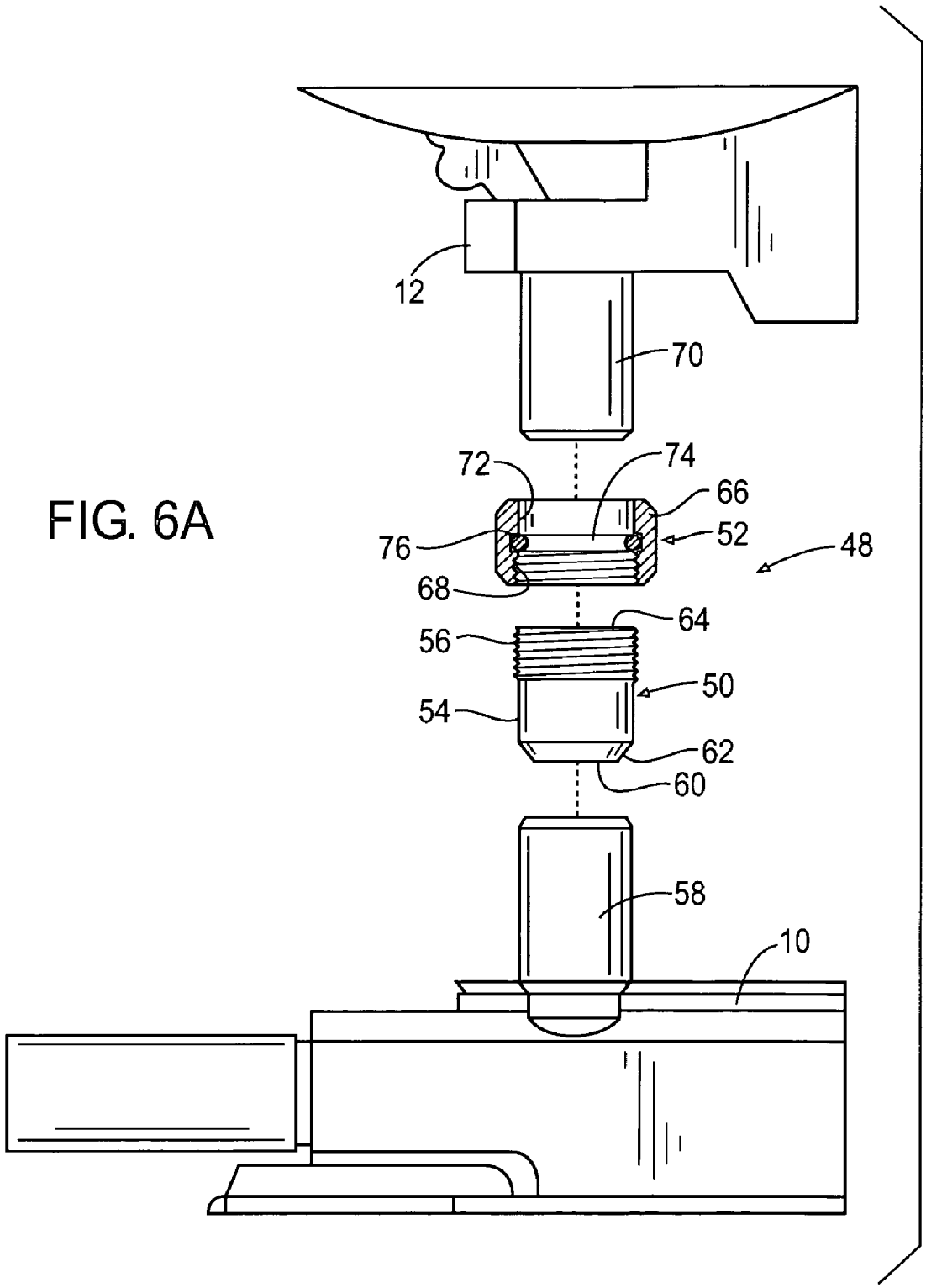
FIG. 6 is an exploded view illustrating the feed adapter of the fourth embodiment of the present invention.
Figure 10:
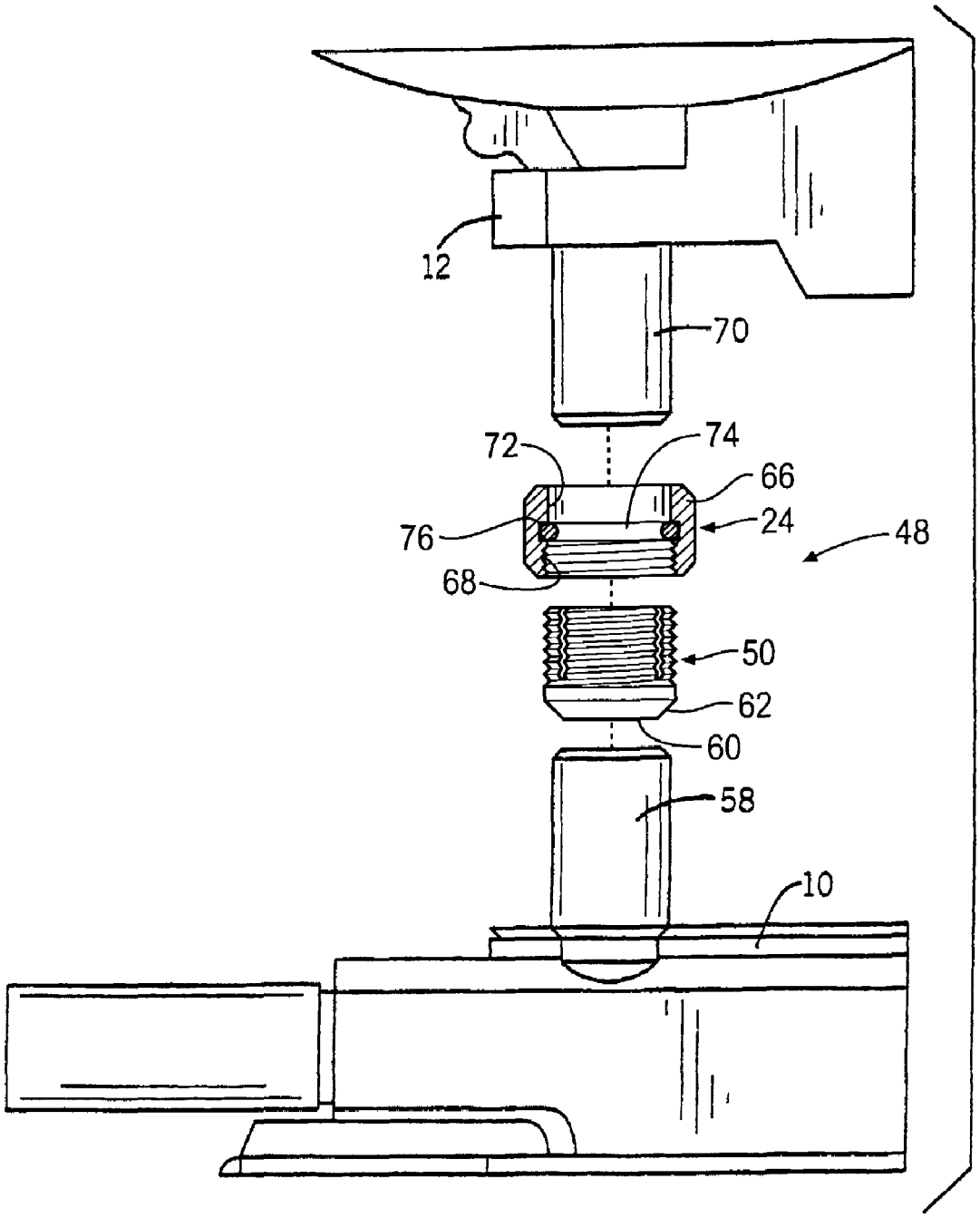
FIG. 10 is an exploded view showing a collet having a tapered inner surface with internal threads.

Referring now to FIG. 6, thereshown is a fourth embodiment of the present invention. The positive fit feed adapter 48 shown in FIG. 6 includes an adapter cylinder 50 and a collet 52. The adapter cylinder 50 includes an insertion portion 54 and a threaded connector portion 56. Preferably, the adapter cylinder 50 is formed form a semi-rigid material that can be compressed without breaking or shattering, such as from plastic or metal. The insertion portion 54 has an outer diameter sized to fit into the inner diameter of the feed tube 58 formed on the paintball gun 10. Although the insertion portion 54 is shown in FIG. 6 as fitting within the inner diameter of the feed tube 58, it is also contemplated that the insertion portion 54 could be sized to fit around the outside of the feed tube 58.

The outer diameter of the adapter cylinder 54 is sized such that the fit between the adapter cylinder 50 and the feed tube 58 is a tight fit in which the adapter cylinder 50 presses against the feed tube walls and compresses slightly to afford a positive fit between the two elements. As illustrated in FIG. 6, the bottom edge 60 of the adapter cylinder 50 includes a tapered surface 62 that aids in the positioning of the insertion portion 54 within the feed tube 58.

As illustrated in FIG. 6, the top end 64 of the adapter 50 includes external threads that mate with corresponding internal threads formed within the collet 52.

Referring now to FIG. 7, the collet 52 includes an outer wall 66 having a series of internal threads 68. In the preferred embodiment of the invention, the outer wall 66 of the collet is formed from a semi-rigid material such as plastic or metal.

The inner surface of the outer wall 66 is sized to fit around the outer diameter of the loader neck 70 of the paintball loader 12, as illustrated in FIG. 6. Referring back to FIG. 7, the inner diameter of the top portion 72 of the collet 52 is sized such that it can fit around the outer diameter of the loader neck 70 to provide a fairly snug fit. In the embodiment of the invention illustrated in FIG. 7, an elastic membrane, such as the O-ring 74, is fitted into an internal notch 76 formed along the interior of the collet 52. The O-ring 74 can be compressed as the loader neck 70 of the paintball loader 12 is inserted into the adapter 50 and feed tube 58 of the paintball gun 10. Although only one O-ring 74 is shown in FIG. 7, it is contemplated that more than one O-ring could be stacked together along the inner surface of the collet 52.

When the loader neck 70 is inserted through the collet 52 and into the feed tube 58, the collet 52 is tightened along the external threads formed on the adapter 54. The top end 64 of the adapter cylinder causes the O-ring 74 to compress and form a positive fit against the outer circumference of the loader neck 70. The embodiment of FIGS. 6 and 7 allows the adapter cylinder 50 and collet 52 to provide a positive fit between the feed tube 58 of the paintball gun 10 and the loader neck 70 of the paintball loader 12 when both of the tubes do not include an externally threaded surface.

Although the embodiment of FIG. 6 includes a separate adapter 50, it is contemplated that an externally threaded connector portion could be formed directly on the feed tube 58 or the loader neck 70, or an elbow adapter, such as shown in FIG. 5, could be used. Thus, the collet 52 having the internal O-ring 74 can replace the collet 24 having a threaded inner surface, as shown in FIGS. 1-5. The collet 52 also allows for the elimination of the compression slots, since the compression of the O-ring 74 provides for the positive fit.

Referring now to FIG. 8, thereshown is yet another embodiment of the present invention. In this embodiment, the feed tube 76 of the paintball gun 10 includes a notch 78 that receives an O-ring 80. The notch 78 is formed in the outer wall of the feed tube 76 and further includes a series of slots 82 cut through the sidewall of the feed tube 76. The slots 82 are sized such that the O-ring 82, when placed over the outer circumference of the feed tube and positioned within the notch 78, will partially pass through the slots such that a portion 81 of the O-ring 82 will define a portion of the inner diameter of the feed tube, as illustrated in FIG. 9. The depth and width of the slots 82, the specific material and elasticity of the O-ring 80, and the diameter of the O-ring 80 determines the amount of the O-ring that protrudes into the interior portion of the feed tube 76.

As can be understood in FIG. 8, when the loader neck 84 of the paintball loader 12 is inserted into the feed tube 76, the protruding portions 81 of the O-ring 80 provide a positive fit between the feed tube 76 of the paintball gun 10 and the loader neck 84 of the paintball loader 12. In this manner, the elastic O-ring 80 simultaneously provides a means for tightening the fit between the paintball loader neck 84 and the paintball gun feed tube 76 by being able to take a variable amount of space between the two members. This dynamic fit provides a positive connection between the two devices and allows the feed tubes to compensate for variations in manufacturing tolerances, variations between the diameters of the feed tubes from different manufacturers, as well as for wear and tear that occurs during repeated insertion and removal of the paintball loader from the paintball gun.

Various alternatives and embodiments are contemplated as being within the scope of the following claims particularly pointing out and distinctly claiming the subject matter regarded as the invention.

I claim:

1. A combination paintball gun and paintball loader including a storage hopper for storing a supply of paintballs, the combination comprising:

a loader neck formed on the paintball loader for supplying paintballs from the storage hopper;

a feed tube formed on the paintball gun for receiving paintballs from the paintball loader;

an adapter cylinder attachable to the feed tube of the paintball gun, the adapter cylinder being sized to receive the loader neck of the paintball loader, the adapter cylinder including an externally threaded connector portion; and a collet receivable on the connector portion of the adapter cylinder, the collet having a tapered inner surface having a series of internal threads formed thereon, wherein the movement of the collet along the connector portion compresses the connector portion.

2. The combination of claim 1 further comprising a resilient O-ring positioned along the inner surface of the collet, wherein the resilient O-ring compresses upon insertion of the loader neck of the paintball loader of the collet.

3. The combination of claim 1 wherein the attachment cylinder is press fit within the feed tube formed on the paintball gun.

* * * * *